United States Patent [19]

Gernez

[11] 4,224,132

[45] Sep. 23, 1980

[54] DEVICE FOR APPLYING VOLTAGE TO A PART FOR ELECTROCHEMICAL TREATMENT

[75] Inventor: Alain Gernez, St. Jean de la Ruelle, France

[73] Assignee: Compagnie Europeenne pour l'Equipement Menager "Cepem", Paris, France

[21] Appl. No.: 20,581

[22] Filed: Mar. 14, 1979

[30] Foreign Application Priority Data

Mar. 31, 1978 [FR] France ..... 78 09497

[51] Int. Cl.² ..... C25D 17/00

[52] U.S. Cl. ..... 204/279

[58] Field of Search ..... 204/279, 300 EC, 280

[56] References Cited

U.S. PATENT DOCUMENTS 3,801,485 4/1974 Kossmann ..... 204/300 EC 4,160,717 7/1979 Navaro et al. ..... 204/279

*Primary Examiner*—Howard S. Williams

*Attorney, Agent, or Firm*—Sughrue, Rothwell, Mion, Zinn and Macpeak

[57] ABSTRACT

A device for applying voltage to a part to be treated by an electrochemical process in which physical contact is established between a current supplying device and the part to be treated only at the moment of treatment, in particular in the case of enamelling by electrophoresis. The device includes an insulating housing (9) for a contact unit, said housing surrounding a connection box (11) connected to electricity supply cables, the insulating housing and the connection box being movable with respect to each other and including contacts (13, 12) which are closed by movement of the insulating housing with respect to the connection box when the contact unit housing is pressed against the part to be treated. The device applies in particular to enamelling by electrophoresis.

11 Claims, 5 Drawing Figures

DEVICE FOR APPLYING VOLTAGE TO A PART FOR ELECTROCHEMICAL TREATMENT

FIELD OF THE INVENTION

The invention relates to a device for applying a voltage to parts to be treated by an electrochemical process, said device preventing the corrosion of the electricity supply parts by the chemical bath prior to the electrochemical treatment in question; and it relates in particular in the case of enamelling by electrophoresis.

BACKGROUND OF THE INVENTION

In general a voltage is applied to parts to be treated via a support for the part; and the electric contact which applies the voltage to the part to be treated (which is to be connected to the positive terminal of a voltage source) is usually provided when the part is already fixed on its support, by means of contact elements made of very hard material capable of withstanding electric arcing phenomena. Since these parts convey high currents, e.g. 500 to 1500 A, depending on the surface areas of the parts to be enamelled, known contact devices often have the disadvantage of requiring holes in the parts to be treated so that the arcing phenomena will not damage these parts too much. In practice this makes it essential to have one type of support per type of part to be treated.

The invention aims to remedy the above disadvantage by producing contacts and contact supports which are independent from the part support and preferred embodiments of the invention can convey high currents so that the conductors:

are not enamelled during the electrophoresis operation when there is no part on the support, as this would require a difficult or even impossible cleaning;

are not made to undergo chemical treatments (alkaline and acid etching) which could damage them or their insulators; and are not made to undergo a flow of hot air when the parts are being dried after enamelling (problem of the high temperature behaviour of the insulators).

The invention also makes it possible for several types of parts to be placed on universal supports thereby avoiding the need to manufacture expensive supports, each individual to one type of part.

SUMMARY OF THE INVENTION

The invention provides a device for applying voltage to a part to be treated by an electrochemical process in which physical contact is established between a current supplying device and the part to be treated only at the moment of treatment, in particular in the case of enamelling by electrophoresis, said device including an insulating housing for a contact unit, said housing surrounding a connection box connected to electricity supply cables, the insulating housing and the connection box being movable with respect to each other and including contacts which are closed by movement of the insulating housing with respect to the connection box when the contact unit housing is pressed against the part to be treated.

An embodiment of the invention is described by way of example with reference to the accompanying drawings.

DESCRIPTION OF THE PREFERRED EMBODIMENT

Figure 1:
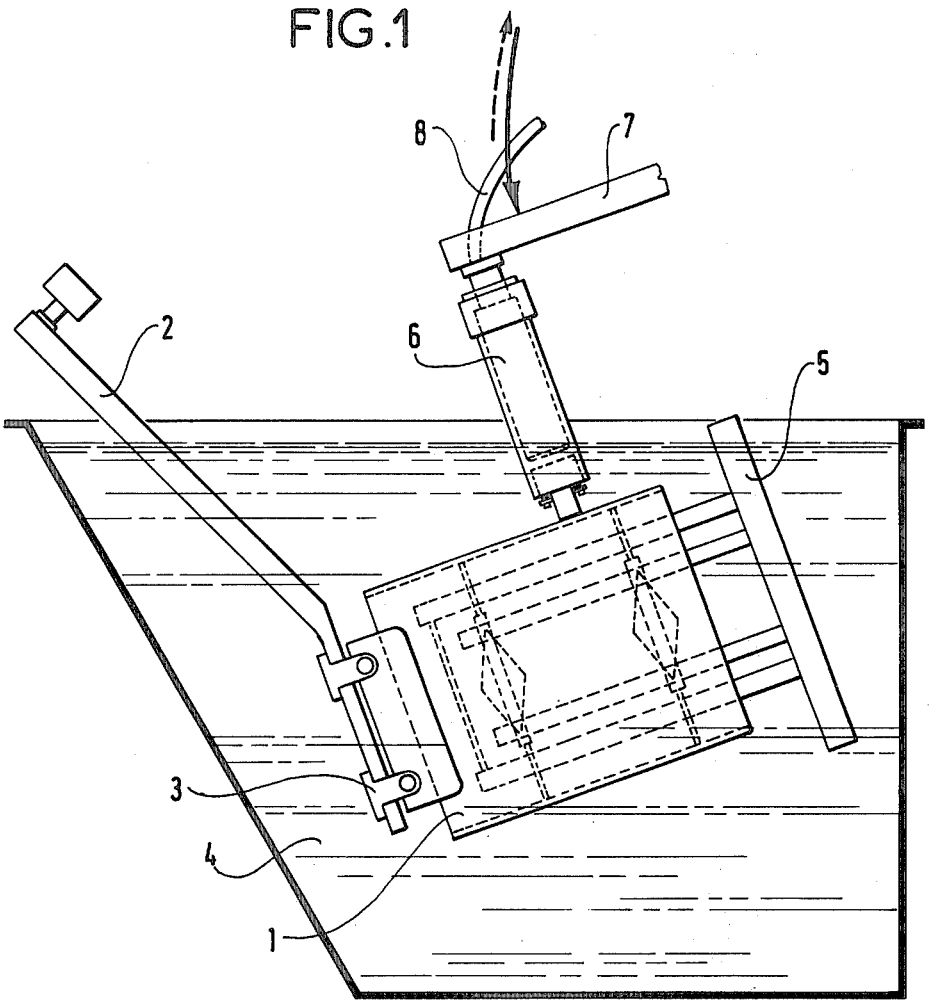
FIG. 1 is an elevational view which illustrates schematically the beginning of the enamelling by electrophoresis operation.

As shown in FIG. 1, a part 1 to be enamelled is fixed on a support 2 by means of insulating webs 3 and is immersed in an electrophoresis bath 4. Negative electrodes 5 are also shown. A current supply device 6 which supplies the part 1 with current is supported by an arm 7 and is connected to the + terminal of a current supply rectifier by a cable 8. The arrows represent the freedom of movement of the assembly formed by the part 1, the support 2, the arm 7 and the electrodes with respect to the bath 4.

Figure 2:
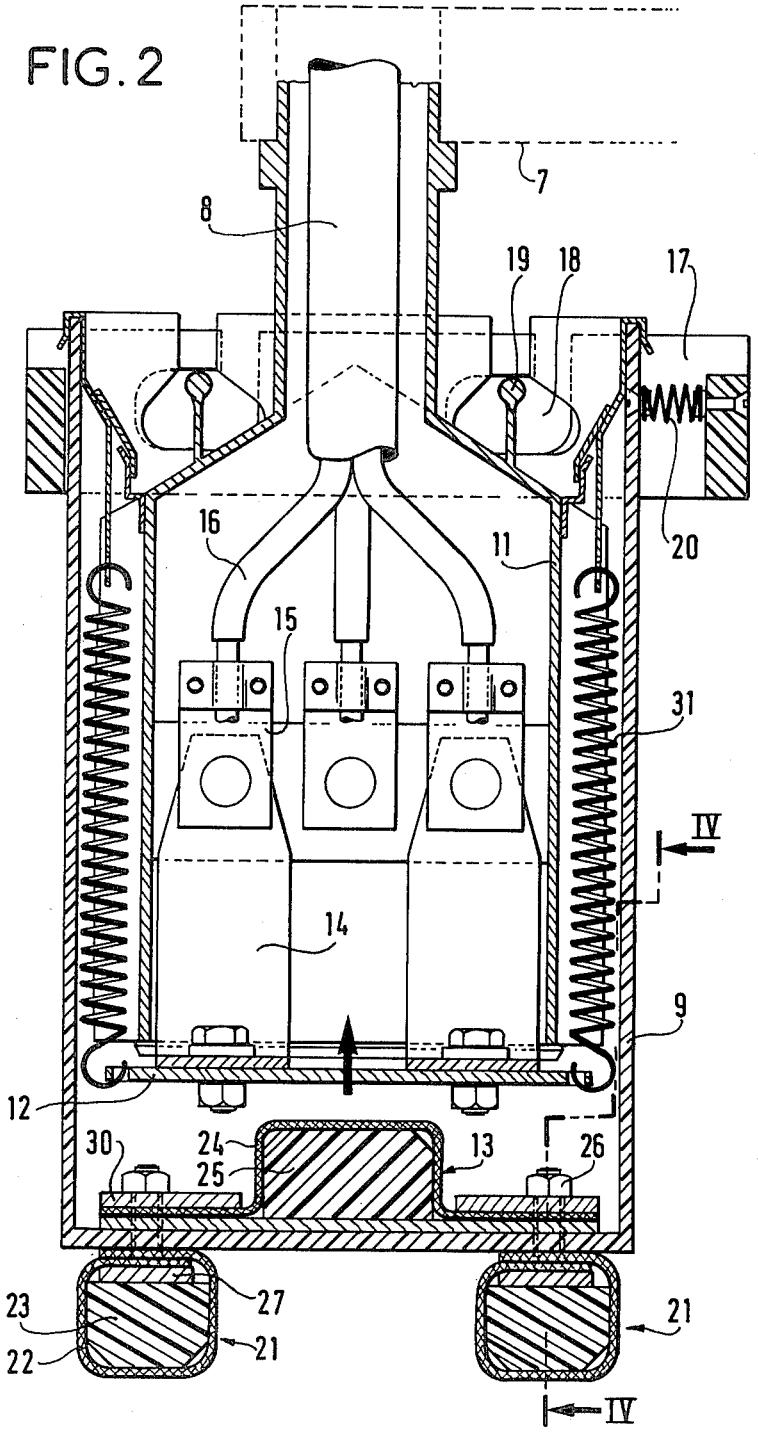
FIG. 2 is an elevation, in section, of a device in accordance with the invention with its contacts open.

FIG. 2 represents the structure of the device 6 for supplying current to the part to be enamelled. The device principally comprises an outer protective casing constituted by a sealed housing 9 made of insulating material and housing current supply parts principally comprising a connection box 11 (e.g. of stainless steel), and including, a conductive plate 12 (e.g. of copper) at its base and designed to come into contact with a conductive contact piece 13 when voltage is applied to the part to be enamelled. The current is conveyed to the plate 12 via copper brackets 14 and lugs 15 to which the conductors 16 of the supply cable 8 are connected.

Figure 5:
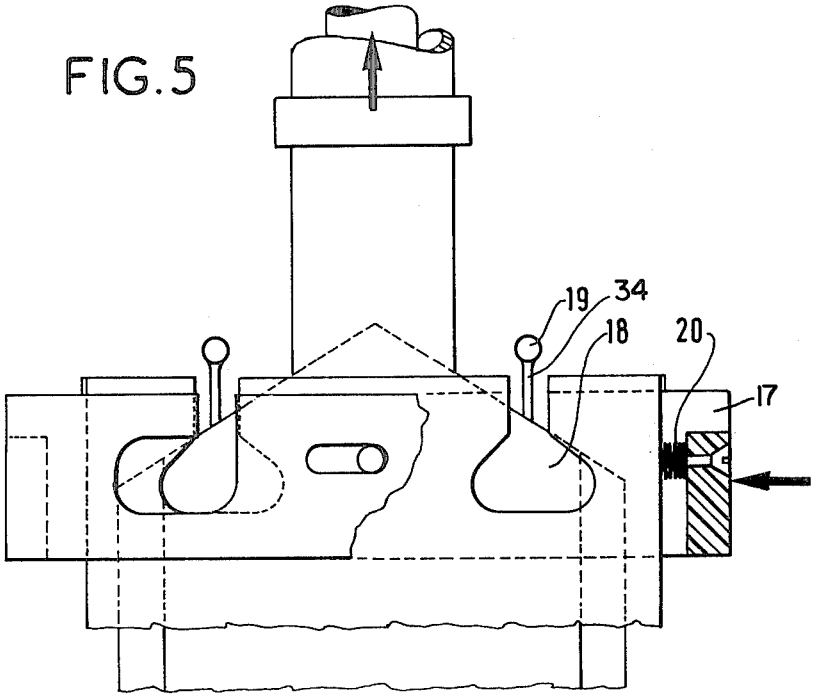
FIG. 5 is an elevational view of the system for fitting the insulating housing on the connection box for the device of FIGS. 2, 3 and 4.

The contact unit housing 9 made of insulating material e.g. PVC, is installed on the connection box 11 by means of a slide bar 17, which is movable perpendicularly to the axis of the housing; the slide bar 17 shown in FIG. 5, includes slots 18 which fix onto contact pieces 19 integral with the connection box and a return spring 20.

Figure 4:
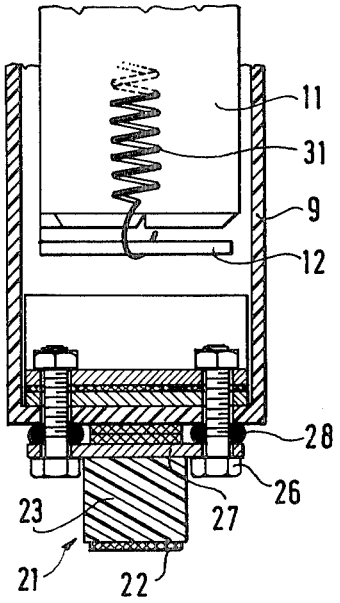
FIG. 4 is a detailed profile view of a contact of the device of FIGS. 2 and 3.

At its base, the insulating housing 9 includes the internal central contact piece 13 and two external contact pieces 21. The contact pieces 21 are constituted by a flat conductive braid 22 (e.g. of copper), which surrounds an expanded rubber block 23. The contact piece 13 also includes a conductive braid 24 and an expanded rubber block 25. The current is transmitted from the braid 22 to the braid 22 via conductive screws 26 and conductive plates 27 and 30 placed transversally with respect to the braid. A seal ring 28 (FIG. 4) seals the through-bushings of the terminals and thereby prevents the electrophoresis slip from entering the housing 9.

The insulating contact unit housing 9 can move along its axis with respect to the connection box 11, by a distance determined by the stroke of the contact pieces 19 in the slot 18 and by stops 32, 33. Draw springs 31 keep the contacts 12 and 13 in the open position by holding the housing 9 in the position shown in FIG. 2, i.e. with the contacts separated.

Figure 3:
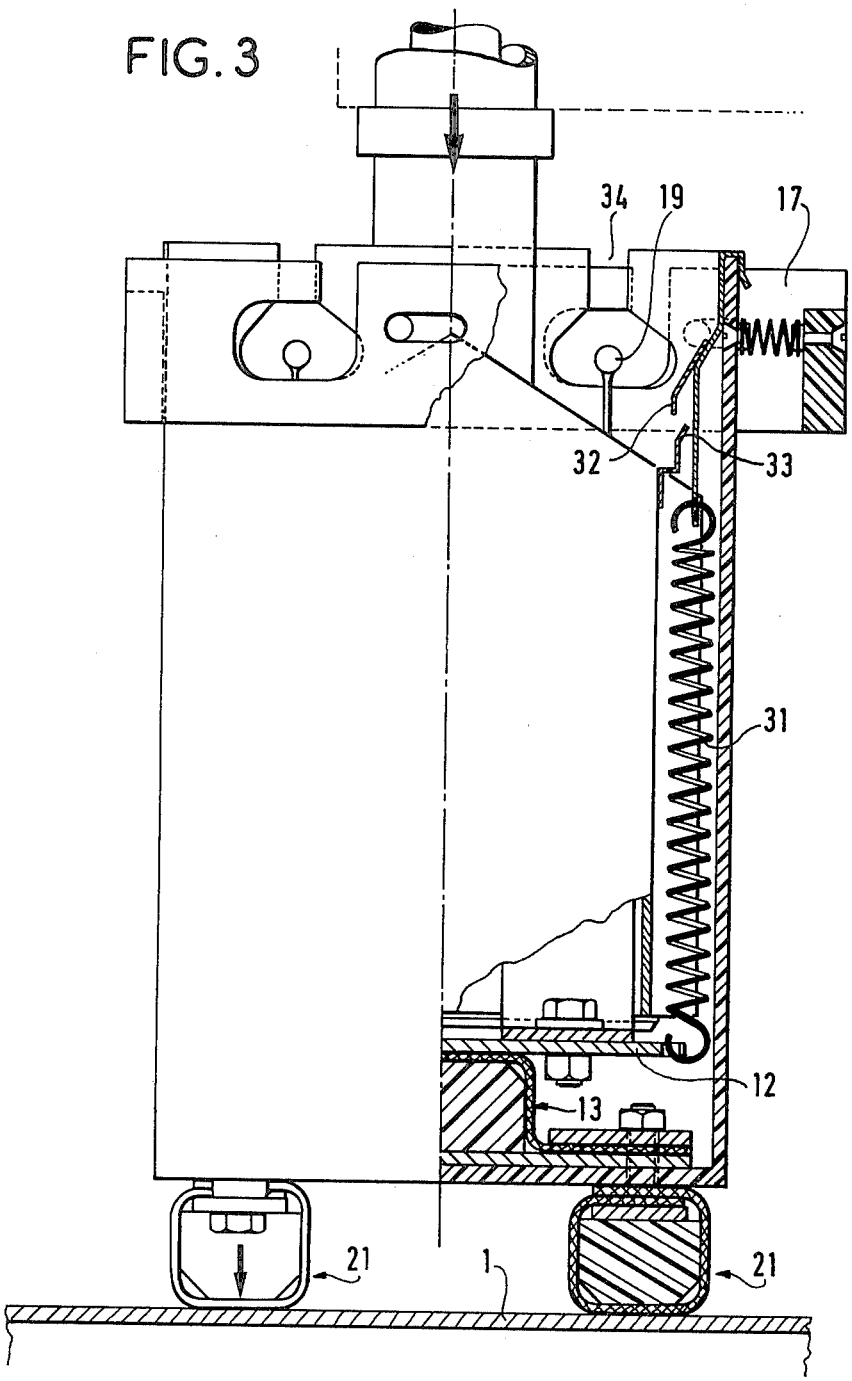
FIG. 3 is a partial sectional view of the device of FIG. 2 with the contacts of the device closed.

In FIG. 3, the conductive plate 12 rests on the contact piece 13 subsequent to pressing the contacts 21 onto the part 1 to be enamelled. The springs 31 are under tension. While the housing 9 is immersed in the electrophoresis bath. The springs 31 also serve to prevent the contacts 12 and 13 from closing under the effect of Archimedean thrust when the housing 9 is immersed in the electrophoresis bath and before pressing against a part to be enamelled.

The contacts 21 designed to be laid on the part to be enamelled are constituted by flat braids of conductive material, preferably copper, wound round a block of expanded foam rubber. They allow the surface of contact between the device and the part to be treated to have a systematically higher value than the minimum necessary for preventing arcing phenomena, whatever the relative inclinations between the "contact" and the part to be treated may be, and with a minimum contact pressure.

The required number of such contact braids to obtain the rated contact surface depends on the current to be passed and on the thickness of the sheet metal.

The disposition in accordance with the invention allows electric contact to be established between the parts 12 and 13 only in the case where the assembly presses against a part to be treated. If there is contact between 12 and 13 when there is no part to be enamelled, the outer braid would be directly opposite the electrophoresis cathodes and would be enamelled; it would then take a very long time to clean the contact and the operation cycle would be slowed down. The disposition in accordance with the invention prevents the braid 21 from having voltage applied thereto when there is no part to be treated and therefore prevents the braid from being enamelled by electrophoresis.

Another advantage of the disposition in accordance with the invention resides in the facility of replacing the housing for the contact unit by another housing in the case of damage to one or both external braids by wear or by accident.

Another advantage is that the part to be treated is insulatively mounted on its support; therefore current cannot pass through the support of the part to be treated. This considerably simplifies the design and manufacture of the supports for the parts and appreciably reduces their cost. This is particularly advatageous in the case of long treatment lines with a large number of supports in service.

The assembly formed by the braid and the foam rubber constitutes a flexible contact which adapts itself to the shapes of the parts to be enamelled and allows the device in accordance with the invention to be pointed in any direction firstly with respect to the part to be treated and secondly with respect to the conductive plate 12.

The device in accordance with the invention satisfies the requirements of industrial mass-production. The housing for the contact unit may be changed very quickly by pushing the slide bar 17 in the direction of the arrow in FIG. 5 and moving it laterally, compressing the spring 20; this clears the slots 34 and allows the contact pieces 19 to pass therethrough.

The insulating housing is therefore removed by sliding it downwards on the connection box. The reverse operation is carried out to install a new housing.

I claim:

1. A current supplying device for applying voltage to a part to be treated by an electrochemical process in which physical contact is established between said current supplying device and the part to be treated only at the moment of treatment, said device comprising: a connection box connected to electricity supply cables, a contact unit, a contact unit insulating housing bearing said contact unit, said housing surrounding said connection box, means supporting the insulating housing and the connection box for movement with respect to each other, and said housing contact unit and said box including, respectively, contact means which are closed by movement of the insulating housing with respect to the connection box when the contact unit housing is pressed against the part to be treated, and said contact unit insulating housing contact means including a portion thereof for direct contact with said part to be treated.

2. A device according to claim 1, wherein the insulating housing contact means includes an internal contact piece which comes into contact with a contact piece of the connection box and at least one external contact piece in electrical contact with the internal contact piece.

3. A device according to claim 2, wherein at least the external contact piece of the insulating housing is a flexible contact piece.

4. A device according to claim 3, wherein the flexible contact piece is made of a conductive braid which surrounds an expanded rubber block.

5. A device according to claim 3, wherein the flexible contact piece is made of a flat braid of conductive material such as copper.

6. A device according to claim 1, wherein the insulating housing for the contact unit is slidably mounted in a fluid-tight manner on the connection box.

7. A device according to claim 1, wherein the insulating housing constitutes a detachable and interchangeable housing for the contact unit

8. A device according to claim 1, further including means for keeping the contacts which are inside the housing normally open, said contacts closing only during operation of the electrochemical process.

9. A device according to claim 8, wherein the contact piece which is inside the insulating housing is kept spaced apart from the contact of the connection box, by means of springs when there is no part to be treated.

10. A device according to claim 1, wherein the contact piece of the connection box is constituted by a conductive plate which is applied on the contact piece which is inside the insulating housing constituted by a central contact piece formed by a block of foam rubber covered with a conductive braid.

11. A device according to claim 1, wherein said contact unit insulating housing contact means includes contact braid inside the contact unit insulating housing and contact braid outside the contact unit insulating housing and a terminal extending through said housing and providing electrical connection between the inside contact braid and the outside contact braid, and wherein a seal provides a fluid-tight sealing for a through bushing housing said terminal.

* * * * *